United States Patent [19]

Hazlett et al.

[11] Patent Number: 4,848,468

[45] Date of Patent: Jul. 18, 1989

[54] ENHANCED HYDRAULIC FRACTURING OF A SHALLOW SUBSURFACE FORMATION

[75] Inventors: Randy D. Hazlett, Dallas; Duane C. Uhri, Grand Prairie, both of Tex.

[73] Assignee: Mobil Oil Corp., New York, N.Y.

[21] Appl. No.: 136,257

[22] Filed: Dec. 22, 1987

Related U.S. Application Data

[63] Continuation-in-part of Ser. No. 938,892, Dec. 8, 1986, Pat. No. 4,714,115.

[51] Int. Cl.[4] ..... E21B 43/26; E21B 49/00

[52] U.S. Cl. ..... 166/300; 166/250; 166/308

[58] Field of Search ..... 166/250, 263, 271, 283, 166/281, 300, 308; 252/8.551

[56] References Cited

U.S. PATENT DOCUMENTS

| | | | |
|---|---|---|---|
| 3,250,328 | 5/1966 | Closmann et al. | 166/308 X |
| 3,896,879 | 7/1975 | Sareen et al. | 166/300 X |
| 4,232,741 | 11/1980 | Richardson et al. | 166/292 X |
| 4,453,596 | 6/1984 | Conway et al. | 166/307 X |
| 4,466,893 | 8/1984 | Dill | 166/307 X |
| 4,548,252 | 10/1985 | Stowe et al. | 166/308 X |
| 4,590,997 | 5/1986 | Stowe | 166/300 X |
| 4,705,810 | 11/1987 | Millet et al. | 521/92 X |
| 4,714,115 | 12/1987 | Uhri | 166/308 |

*Primary Examiner*—George A. Suchfield
*Attorney, Agent, or Firm*—Alexander J. McKillop; Charles J. Speciale; Charles A. Malone

[57] ABSTRACT

A method for extending a vertical fracture formed in a formation having original in-situ stresses that favor the propagation of a horizontal fracture. In this method, a subsurface formation having original in-situ stresses that favor the propagation of a horizontal fracture is penetrated by a cased borehole which is perforated at a pair of spaced-apart intervals to form separate pairs of perforations. Fracturing fluid is initially pumped down said cased borehole and out one of said sets of perforations to form the originally favored horizontal fracture. The propagation of this horizontal fracture changes the in-situ stresses so as to favor the propagation of a vertical fracture. Said horizontal fracture is extended by placing a chemical blowing agent and surfactant into the fracturing fluid. Gas released by decomposition of said agent causes foam to be generated along with an increase in pressure thereby extending the horizontal fracture. Thereafter, while maintaining pressure on said horizontal fracture, fracturing fluid is pumped down said cased borehole and out of the other of said sets of perforations to form the newly favored vertical fracture.

21 Claims, 2 Drawing Sheets

ENHANCED HYDRAULIC FRACTURING OF A SHALLOW SUBSURFACE FORMATION

RELATED APPLICATIONS

This application is a continuation-in-part of copending application Ser. No. 938,892, filed Dec. 8, 1986, now U.S. Pat. No. 4,714,115.

FIELD OF THE INVENTION

This invention relates to the hydraulic fracturing of subterranean formations and more particularly to the forming of a vertical hydraulic fracture in a subterranean formation that is normally disposed to form a horizontal hydraulic fracture.

BACKGROUND OF THE INVENTION

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation. Fluids, such as oil or gas, are produced through these perforations into the well.

Hydraulic fracturing is widely practiced to increase the production rate from such wells. Fracturing treatments are usually performed soon after the formation interval to be produced is completed, that is, soon after fluid communication between the well and the reservoir interval is established. Wells are also sometimes fractured for the purpose of stimulating production after significant depletion of the reservoir.

Hydraulic fracturing techniques involve injecting a fracturing fluid down a well and into contact with the subterranean formation to be fractured. Sufficiently high pressure is applied to the fracturing fluid to initiate and propagate a fracture into the subterranean formation. Proppant materials are generally entrained in the fracturing fluid and are deposited in the fracture to maintain the fracture open.

Several such hydraulic fracturing methods are disclosed in U.S. Pat. Nos. 3,965,982; 4,067,389; 4,378,845; 4,515,214; and 4,549,608 for example. It is generally accepted that the in-situ stresses in the formation at the time of such hydraulic fracturing generally favor the formation of vertical fractures in preference to horizontal fractures at depths greater than about 2000 to 3000 ft. while at shallower depths such in-situ stresses can favor the formation of horizontal fractures in preference to vertical fractures.

For oil or gas reservoirs found at such shallow depths, significant oil or gas production stimulation could be realized if such reservoir were vertically fractured. For example, steam stimulation of certain heavy oil sands would be enhanced and productivity would be optimized in highly stratified reservoirs with low vertical permeability.

It is therefore a specific object of the present invention to provide for a hydraulic fracturing method that extends a propagated vertical fracture in a subsurface formation where the in-situ stresses favor a horizontal fracture.

SUMMARY OF THE INVENTION

The present invention is directed to a hydraulic fracturing method for extending a propagated vertical fracture in an earth formation surrounding a borehole wherein the original in-situ stresses favor a horizontal fracture.

In the practice of this invention an aqueous slug, containing a chemical blowing agent and a surfactant, is injected into a first depth within said borehole. The blowing agent is sensitive to formation heat. Subsequently, a fracturing fluid is injected behind said slug at the first depth. The fracturing fluid is pumped at a rate and pressure sufficient to propagate a horizontal fracture as favored by the original in-situ stresses. Thereafter, the chemical blowing agent decomposes and creates foam and pressure which extends the propagated fracture to a substantially greater distance.

The propagation and extension of the horizontal fracture changes the in-situ stresses so as to favor the propagation of a vertical fracture. Thereafter, a fracturing fluid is applied to said borehole at a second depth while maintaining pressure on said horizontal fracture thereby causing the propagation of a now favored vertical fracture.

It is therefore an object of this invention to extend a propagated horizontal fracture to a substantially greater distance in a formation which allows a subsequently propagated vertical fracture to extend to a greater depth in said formation.

It is another object of this invention to provide for the propagation of hydraulic fractures to greater distances than heretofore possible with conventional hydraulic fracturing methods.

It is yet another object of this invention to alleviate injectivity problems by utilizing a single phase fracturing fluid which can both propagate and extend hydraulic fractures.

It is a still yet further object of this invention to provide for an in-situ foam and gas generation method which can extend propagated fractures.

It is a still even further object of this invention to increase the effectiveness of a fracturing fluid while reducing the amount of chemicals used to produce a pressure generating foam.

DESCRIPTION OF THE PREFERRED EMBODIMENT

Figure 1:
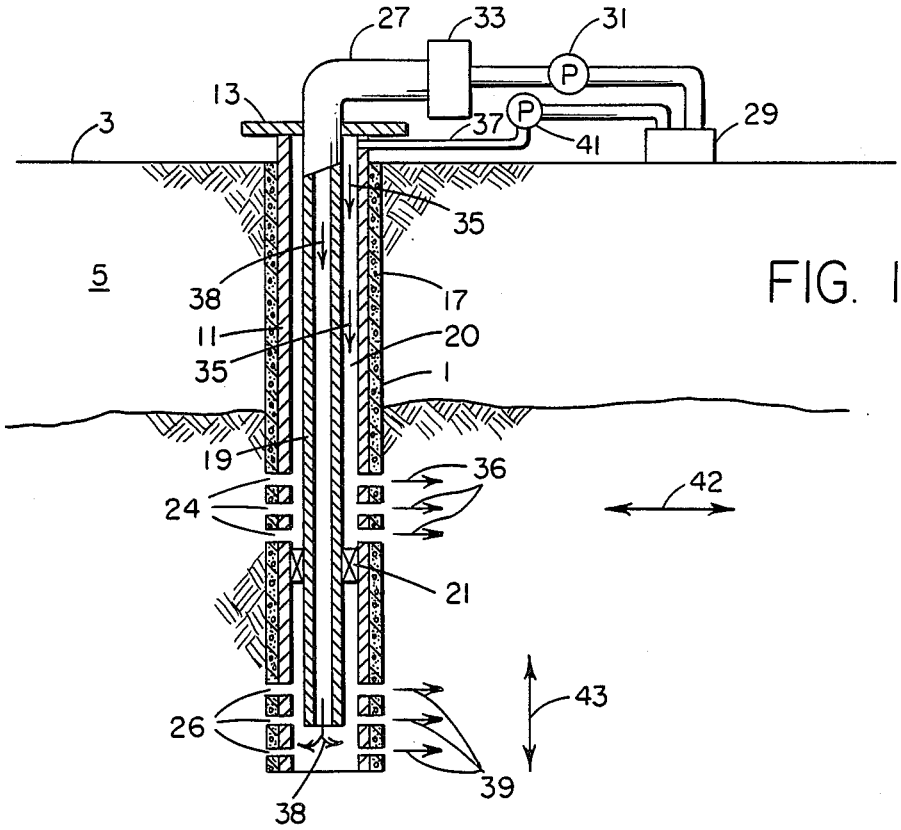
FIG. 1 illustrates a borehole apparatus penetrating an earth formation to be hydraulically fractured in accordance with the present invention.
Figure 3:
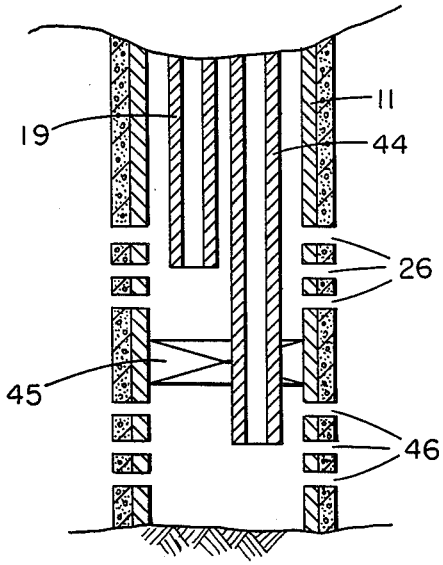
FIG. 3 is a partial view of the bottom portion of the apparatus of FIG. 1 showing additional features of an alternate embodiment in accordance with the present invention.

Referring now to FIG. 1 there is shown formation fracturing apparatus within which the hydraulic fracturing method of the present invention may be carried out. A wellbore 1 extends from the surface 3 through an overburden 5 to a shallow productive formation 7 where the in-situ stresses favor a horizontal fracture. Casing 11 is set in the wellbore and extends from a casing head 13 to the productive formation 7. The casing 11 is held in the wellbore by a cement sheath 17 that is formed between the casing 11 and the wellbore 1. The casing 11 and cement sheath 17 are perforated at 24 where the local in-situ stresses favor the propagation of a horizontal fracture and at 26 where the local in-situ stresses also favor the propagaton of a horizontal fracture. A tubing string 19 is positioned in the wellbore and extends from the casing head 13 to the lower end of the wellbore below the perforations 26. A packer 21 is placed in the annulus 20 between the perforations 24 and 26. The upper end of tubing 19 is connected by a conduit 27 to a source 29 of fracturing fluid. A pump 31 is provided in communication with the conduit 27 for pumping the fracturing fluid from the source 29 down the tubing 19. The upper end of the annulus 20 between the tubing 19 and the casing 11 is connected by a conduit 37 to the source 29 of fracturing fluid. A pump 41 is provided in fluid communication with the conduit 37 for pumping fracturing fluid from the source 29 down the annulus 20.

In carrying out the hydraulic fracturing method of the present invention with the apparatus of FIG. 1 in a zone of the formation where the in-situ stresses favor a horizontal fracture, such a horizontal fracture 42 is initially propagated by activating the pump 41 to force fracturing fluid down the annulus 20 as shown by arrows 35 through the performations 24 into the formation as shown by arrows 36 at a point immediately above the upper packer 21. The fact that this will be a horizontal fracture in certain formations can best be seen by reference to FIG. 2 where three orthogonal principle original in-situ stresses are operative. These in-situ stresses are a vertical stress ($\sigma_v$) of 1800 psi for example, a minimum horizontal stress ($\sigma_h$min) of 1100 psi for example, and a maximum horizontal stress ($\sigma_h$max) of 1300 psi for example. It is generally accepted that the in-situ stresses in the formation at the time of hydraulic fracturing generally favor the formation of vertical fractures in preference to horizontal fractures at depths greater than about 2000 to 3000 ft. while at shallower depths such in-situ stresses can favor the formation of horizontal fractures in preference to vertical fractures.

The mean horizontal stress ($\sigma_h$) is, therefore 1200 psi. This results in a ratio of mean horizontal stress to vertical stress ($\sigma_h/\sigma_v$) of 0.667. Using this value and the equations set forth in "Introduction to Rock Mechanics" by R. E. Goodman, John Wiley and Sons, N.Y., 1980, pps. 111–115, a vertical stress of greater than 2000 psi is required for a vertical fracture to form. Typical ranges of $\sigma_h/\sigma_v$ are 0.5 to 0.8 for hard rock and 0.8 to 1.0 for soft rock such as shale or salt. For the foregoing example, a fluid pressure of 1900 psi is maintained during the initial propagation of a horizontal fracture 42 by controlling the fracturing fluid flow rate through annulus 20 or by using well known gelling agents.

Figure 2:
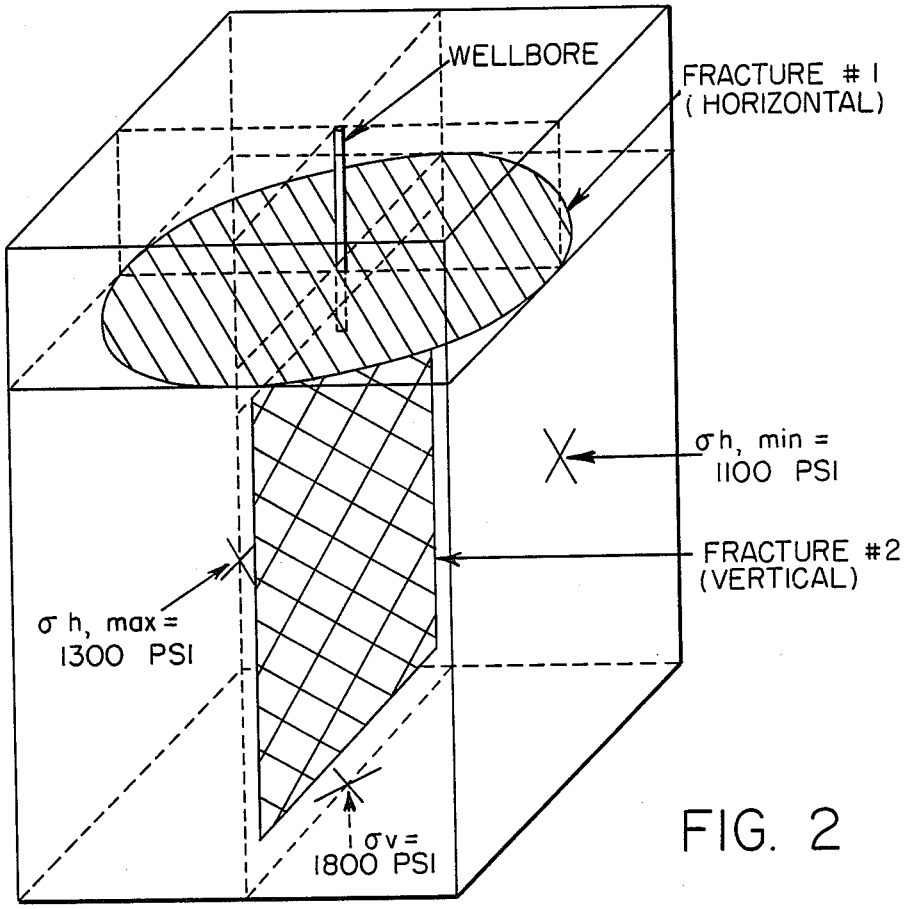
FIG. 2 is a pictorial representation of hydraulic fractures, formed in the earth formation by use of the apparatus of FIG. 1.

Due to the pressure in the horizontal fracture 42, the local in-situ stresses in the formation 7 are now altered from the original stresses of FIG. 2 to favor the formation of a vertical fracture 43. Such a vertical fractures 43 can thereafter be formed in formation 7 by activating the pump 31 to force fracturing fluid out the bottom of tubing 19 as shown by arrows 38 and through the perforations 26 into the formation as shown by arrows 39 at a point near the bottom of the wellbore. This vertical fracture 43 is propagated while maintaining the fluid pressure on the horizontal fracture 42, which can either be stabilized in length or still propagating.

The height of vertical fracture 43 is relative to that of the horizontal fracture 42. For an essentially circular horizontal fracture, the height of the vertical fracture is about equal to the diameter of the horizontal fracture. Should the vertical fracture become too large relative to the horizontal fracture, it will curve and eventually become a horizontal fracture at some distance from the well.

The distance that the horizontal fracture travels from the well can be extended by incorporating into the fracturing ("frac") fluid a chemical for generating additional pressure. These chemical comprise a chemical blowing agent and a surfactant which are added into an aqueous solution sufficient to create a foam. The amount of chemical blowing agent utilized will be from about 0.51% to about 5.0% by weight. The amount of surfactant utilized will be an amount sufficient for foam stabilization and will generally be from about 0.1% to about 2% by weight. After mixing the blowing agent and surfactant together in an aqueous medium, a slug of the aqueous medium, containing said surfactant and chemical blowing agent in an amount sufficient to generate a volume of gas sufficient to create a fracturing pressure to extend the horizontal fracture, is placed into the frac fluid. After this slug has been injected into the formation to a desired distance, additional frac fluid is injected into a first depth within the perforated casing. The formation is fractured at the first depth thus creating a horizontal fracture. Once the horizontal fracture has propagated to its greatest extent, heat of the formation being in excess of about 125° F. causes the chemical blowing agent to decompose thereby liberating a gas sufficient to create foam and a pressure buildup. Pressure is maintained on the formation while the propagated horizontal fracture extends to a greater distance into the formation.

While pressure is being maintained on the horizontal fracture, fracturing fluid is supplied to the formation at a second depth within said borehole. Said fracturing fluid enters said second depth at a rate and pressure sufficient to create a vertical fracture. A vertical fracture is favored by the in-situ stresses as altered by the propagated and extended horizontal fracture. Since the horizontal fracture has been extended to a greater distance in the formation because of the in-situ foam generated therein, the propagated vertical fracture can be extended to a substantially greater distance before curving and being converted into a horizontal fracture.

The distance that the vertical fracture travels before curving and converting into a horizontal fracture can be extended even further. This is accomplished by placing alternate aqueous slugs into the formation via the first fracture which slugs contain increased amounts of a chemical blowing agent and a surfactant thereby producing more foam and generating additional pressure. The distance that the horizontal fracture has traveled is then determined.

The effectiveness of fracturing at each stage of this method can be determined by available methods. One such method is described in U.S. Pat. No. 4,415,805 issued to Fertl et al. This patent is incorporated herein by reference. In this method a multiple stage formation fracturing operation is conducted with separate radioactive tracer elements injected into the well during each stage of the fracturing operation. After completion of the fracturing operation, the well is logged using natural gamma ray logging. The resulting signals are sorted into individual channels or energy bands characteristic of each separate radioactive tracer element. Results of the multiple stage fracturing operation are evaluated based on dispersement of the individual tracer elements.

If it is desired to extend the vertical fracture to that distance determined for the extended horizontal fracture, an aqueous slug containing a blowing agent and a surfactant can be used as mentioned above when the horizontal fracture was extended. This may particularly be required when the fracture has extended beyond the distances obtainable via conventional hydraulic fracturing methods.

The method of this invention can be practiced by incorporating a chemical blowing agent and a surfactant into the frac fluid. Afterwards the frac fluid can be injected into the formation. The blowing agent selected could comprise one which will become active only after hydraulic fracturing has occurred. Chemical blowing agents which can be utilized herein include dinitrosopentamethylenetetramine (DNPT), blends of sodium hydrogen carbonate, and nitrogen releasing agents such as p-toluene sulfonyl hydrazide and p,p'-oxybis(benzenesulfonyl hydrazide). Other chemical blowing agents which can be utilized include azodicarbonamide, and salts of azodicarboxylic acid.

DNPT and sodium hydrogen carbonate can be used in conjunction with normal waterflooding operations. Since DNPT is only slightly soluble in cold water, warm water is required to achieve significant water solubility. Warm water can be obtained by preheating water to be injected or reinjection of warm produced water. Enhancement of the low temperature solubility of DNPT can be obtained by the use of chemicals. Said chemicals include dimethylformamide (DMF) and dimethylsulfoxide (DMSO). As will be understood by those skilled in the art, the amount of chemical utilized will depend upon such factors as the amount and temperature of water utilized, chemical composition of the water, and the amount of DNPT utilized.

Although sodium hydrogen carbonate and other bicarbonate foaming agents can be utilized, they are limited by an equilibrium which reduces yield with increasing pressure. To overcome this limitation, bicarbonate decomposition can be pH drive with formulations containing suitable compounds for pH depression with temperature increase. One such compound is the nitrogen releasing blowing agent, p-toluene sulfonyl hydrazide. Bicarbonate decomposition generates carbon dioxide. The addition of a suitable amount of p-toluene sulfonyl hydrazide, which generates acidic compounds upon decomposition, causes substantially increased volumes of carbon dioxide to be released from solution due to bicarbonate decomposition.

Azodicarbonamide similar to DNPT is soluble in water only at elevated temperatures. Since azodicarbonamide is available in powder form with average particle size in the micron range, solid dispersions can be utilized. A dispersion can be made by placing micron sized azodicarbonamide in a suitable surfactant solution. The amount of azodicarbonamide should be sufficient to create the volume of gas required to obtain a fluid diversion effect. One such suitable class of surfactants is the alkyl napthelene sulfonates, which can be purchased from GAF as the Nekel series, located in New York. Should it be desired to accelerate the decomposition of azodicarbonamide, an alkali carbonate can be utilized to obtain decomposition from the injection point to a desired distance in the formation. Alkali carbonates which can be utilized include sodium carbonate and potassium carbonate. Thus, azodicarbonamide will prove to have enhanced potential for use in carbonate reservoirs. Azodicarbonamide can be included in a microemulsion for injection into the formation. A method for making a microemulsion is disclosed in U.S. Pat. No. 4,008,769 which issued to Chang on Feb. 22, 1977. This patent is incorporated by reference herein.

The sodium salt of azodicarboxylic acid can be used as a chemical blowing agent. This blowing agent can be formed on site by the treatment of azodicarbonamide with sodium hydroxide and alkali carbonate with resulting ammonia evolution. When heated, this salt liberates nitrogen and carbon dioxide, yet it is very stable at room temperature in basic solutions having a pH greater than 12. The pH decline from hydroxide consumption will accelerate the foam decomposition reaction. Toluene sulfonyl hydrazide and p,p'-oxybis(benzenesulfonyl hydrazide) also develop water solubility at high pH, but the modified azodicarbonamide is preferred.

Examples of suitable surfactants comprise nonionic and anionic surfactants, commercially available sodium dodecylbenzene sulfonates, e.g., Siponate DS-10 available from American Alcolac Company, mixtures of the Siponate or similar sulfonate surfactants with sulfated polyoxyalkylated alcohol surfactants, e.g., the NEODOL sulfate surfactants available from Shell Chemical Company; sulfonate sulfate surfactant mixtures, e.g., those described in the J. Reisberg, G. Smith and J. P. Lawson U.S. Pat. No. 3,508,612; petroleum sulfonates available from Bray Chemical Company; Bryton sulfonates available from Bryton Chemical Company; Petronates and Pyronates available from Sonnoborn Division of Witco Chemical Company; fatty acid and tall oil acid soaps, e.g., Actynol Heads from Arizona Chemical Company; nonionic surfactants, e.g., Triton X100; and the like surfactant materials which are soluble or dispersible in aqueous liquids. These surfactants are disclosed in U.S. RE Pat. No. 30,935 which issued to Richardson et al. on May 18, 1982. This patent is incorporated herein by reference.

Water used to mix the chemical blowing agents and surfactant can comprise fresh water, formation water, brackish water, or salt water.

In both embodiments, the chemical blowing agent is selected on the basis of reservoir temperature, mineralogy, depth, and environmental conditions. As required, pH buffers, accelerators, or inhibitors can be incorporated into the aqueous chemical slug prior to injection into the formation or reservoir. Choice of accelerators or inhibitors would be specific to the selected blowing agent. Accelerators which can be used for azodicarbonamide include alkali carbonates, basic metal salts of lead, cadmium, or zinc such as dibasic lead phthalate, and polyols such as glycols and glycerol. Inhibitors which can be utilized include barium salts and neutral pH buffers. Accelerators which can be used for DNPT include mineral acids and salts of mineral acids such as zinc chloride. Stabilizers which can be used for DNPT include oxides, hydroxides, or carbonates of calcium, barium, zinc, or magnesium. The size of the chemical slug would depend upon the extent of the prescribed treatment area. The injection rate of the chemical slug should be sufficient to allow fluid placement into the zone or zones desired to be treated prior to significant gas release. Bubbles or foam generated in a high permeability zone will lead to flow diversion and enhanced sweep of the formation or reservoir.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for enhancing the propagation of a vertical hydraulic fracture in an earth formation surrounding a borehole where the original in-situ stresses favor a horizontal fracture, comprising:

(a) supplying a slug of fracturing fluid containing water, a chemical blowing agent, and a surfactant into said formation at a first depth within said borehole which surfactant and blowing agent are contained in said slug in an amount sufficient to generate fracturing pressure after propagating a horizontal hydraulic fracture;

(b) supplying additional fracturing fluid at said first depth thereby fracturing said formation and propagating a horizontal fracture which places said slug a desired distance from said well;

(c) causing said chemical blowing agent to decompose and liberate gas sufficient to form a foam thereby extending said propagated horizontal fracture further into the formation; and (d) supplying fracturing fluid to said formation at a second depth within said borehole, while maintaining pressure in said horizontal fracture, thereby propagating a vertical fracture to an extended distance as favored by the in-situ stresses as altered by the propagating of said horizontal fracture.

2. The method as recited in claim 1 where after step (c) a slug containing water, said blowing agent and surfactant in increased amounts is injected into said formation at said first depth thereby further extending said horizontal fracture and allowing further propagation of said vertical fracture.

3. The method as recited in claim 1 where in step (d) an aqueous slug containing said blowing agent and surfactant is injected into the second depth thereby extending the propagated vertical fracture.

4. The method as recited in claim 1 where said water comprises fresh water, formation brine, sea water, or brackish water.

5. The method as recited in claim 1 where said chemical blowing agent is dinitrosopentamethylenetetramine which decomposes to release nitrogen gas.

6. The method as recited in claim 1 where said chemical blowing agent is azodicarbonamide.

7. The method as recited in claim 1 where said chemical blowing agent is azodicarbonamide where decomposition is accelerated by alkali carbonates.

8. The method as recited in claim 1 wherein said chemical blowing agent is the sodium salt of azodicarboxylic acid which upon decomposition liberates nitrogen and carbon dioxide gases.

9. The method as recited in claim 1 where said chemical blowing agent is p,p'-oxybis(benzenesulfonyl hydrazide).

10. The method as recited in claim 1 where said chemical blowing agent is sodium hydrogen carbonate and p-toluene sulfonyl hydrazide which decompose to release nitrogen and carbon dioxide gases.

11. The method as recited in claim 1 where said aqueous slug contains therein a pH adjustor, an accelerator, or an inhibitor sufficient to provide for variable propagation distances within said formation prior to foam generation.

12. A method for enhancing the propagation of a vertical hydraulic fracture in an earth formation surrounding a borehole where the original in-situ stresses favor a horizontal fracture comprising:

(a) supplying a fracturing fluid containing water, a chemical blowing agent, and a surfactant into said formation at a first depth within said borehole which surfactant and blowing agent are in said fluid in an amount sufficient to generate fracturing pressure after propagating a horizontal fracture;

(b) causing said chemical blowing agent to decompose and liberate gas sufficient to form a foam thereby extending said propagated horizontal fracture further into said formation; and (c) supplying fracturing fluid to said formation at a second depth within said borehole, while maintaining pressure in said horizontal fracture, thereby propagating a vertical fracture to an extended distance as favored by the in-situ stresses as altered by the propagating of said horizontal fracture.

13. The method as recited in claim 12 where in step (c) an aqueous slug containing said blowing agent and surfactant is injected into said second depth thereby extending the propagated vertical fracture.

14. The method as recited in claim 12 where said water comprises fresh water, formation brine, sea water, or brackish water.

15. The method as recited in claim 12 where said chemical blowing agent is dinitrosopentamethylenetetramine which decomposes to release nitrogen gas.

16. The method as recited in claim 12 where said chemical blowing agent is sodium hydrogen carbonate and p-toluene sulfonyl hydrazide which decompose to release carbon dioxide and nitrogen gases.

17. The method as recited in claim 12 where said chemical blowing agent is azodicarbonamide.

18. The method as recited in claim 12 where said chemical blowing agent is azodicarbonamide where decomposition is accelerated by alkali carbonates.

19. The method as recited in claim 12 where said chemical blowing agent is the sodium salt of azodicarboxylic acid which upon decomposition liberates nitrogen and carbon dioxide gases.

20. The method as recited in claim 12 where said chemical blowing agent is p,p'-oxybis(benzenesulfonyl hydrazide).

21. The method as recited in claim 12 where said aqueous slug contains therein a pH adjustor, an accelerator, or an inhibitor sufficient to provide for variable propagation distances within said formation prior to foam generation.

* * * * *